US008550286B2

(12) United States Patent
Lukiyanets et al.

(10) Patent No.: US 8,550,286 B2
(45) Date of Patent: Oct. 8, 2013

(54) HIGH-PRESSURE CONTAINER

(75) Inventors: Sergey V. Lukiyanets, Prag 5-Zlicin (CZ); Nikolay G. Moroz, Mizosov (CZ)

(73) Assignee: Armotech S.R.O. (CZ)

( * ) Notice: Subject to any disclaimer, the term of this patent is extended or adjusted under 35 U.S.C. 154(b) by 223 days.

(21) Appl. No.: 13/059,245

(22) PCT Filed: Aug. 26, 2009

(86) PCT No.: PCT/EP2009/006181
§ 371 (c)(1),
(2), (4) Date: Mar. 3, 2011

(87) PCT Pub. No.: WO2010/022927
PCT Pub. Date: Mar. 4, 2010

(65) Prior Publication Data

US 2011/0139796 A1 Jun. 16, 2011

(30) Foreign Application Priority Data

Aug. 27, 2008 (RU) ..... 2008134618

(51) Int. Cl.
*F17C 1/02* (2006.01)

(52) U.S. Cl.
USPC ..... 220/589; 220/588; 220/586

(58) Field of Classification Search
CPC ..... F17C 1/06
USPC ..... 220/588, 589, 590, 591, 586, 581
See application file for complete search history.

(56) References Cited

U.S. PATENT DOCUMENTS 5,375,735 A * 12/1994 Huvey et al. ..... 220/589
6,241,116 B1 6/2001 Schrepfer
6,547,092 B1 * 4/2003 Chervatsky ..... 220/581
6,548,166 B2 * 4/2003 Figuly et al. ..... 428/370
6,656,586 B2 * 12/2003 Hartzog et al. ..... 428/397
2011/0056960 A1 * 3/2011 Blanc et al. ..... 220/588

FOREIGN PATENT DOCUMENTS

DE 10022741 A 1/2001
JP 08145296 A 6/1996
JP 2008057632 A 3/2008

* cited by examiner

*Primary Examiner* — Stephen Castellano
(74) *Attorney, Agent, or Firm* — Andrew Wilford

(57) ABSTRACT

The aim of the invention is to increase the strength and reliability of a high-pressure container. To achieve this, the high-pressure container comprises a thin-walled, closed, sealed, metal cylindrical liner (1) with at least one neck and at least one outer reinforcement jacket (2) consisting of a composite material that is formed from at least one group of layers of high modulus fiber of a reinforcement material, said fibers being aligned spirally and in an annular direction in relation to the cylindrical liner (1) and having previously determined linear arrangement densities. One layer of fibers of the spiral reinforcement (4) is positioned above a layer of fibers of the annular reinforcement (3). The invention is characterized in that a local predetermined breaking point band is formed in the reinforcement jacket as part of said jacket (2), the band being delimited on the interior by the cylindrical surface of the liner (1) and on the exterior by a concave surface in relation to the liner (1), said concave surface being formed from spiral fibers of the reinforcement material. The linear arrangement density of the fibers of the reinforcement material aligned in an annular direction (3) in the region of the local predetermined breaking point band is less than or equal to 70% of the linear arrangement density of the fibers of the reinforcement material aligned in an annular direction (3) in the remainder of the cylindrical part.

7 Claims, 4 Drawing Sheets

HIGH-PRESSURE CONTAINER

CROSS REFERENCE TO RELATED APPLICATIONS

This application is the US national phase of PCT application PCT/EP2009/006181, filed 26 Aug. 2009, published 4 Mar. 2010 as WO2007/022927, and claiming the priority of Russian patent application 2008134618 itself filed 27 Aug. 2008, whose entire disclosures are herewith incorporated by reference.

FIELD OF THE INVENTION

The present invention relates to a high-pressure container, which comprises a thin-walled, closed, leakproof metallic liner with a cylindrical portion and at least one neck and an outer reinforcing jacket of composite material surrounding the liner, which jacket is formed of at least one group of layers of high modulus fibers of a reinforcing material, these being oriented spirally and annularly relative to the liner with a previously determined linear density, a layer of spirally oriented fibers being arranged over a layer of annularly oriented fibers. The high-pressure container may in particular be used in portable oxygen respirators for mountaineers and rescue workers, in mobile refrigeration and fire protection products, in gas supply systems and in automotive engineering.

BACKGROUND OF THE INVENTION

Metal-plastic high-pressure containers currently produced have an inner leakproof metal jacket (liner) and an outer reinforcing plastics jacket, which is formed in that a strand of high modulus fibers (for example glass fibers, carbon fibers, organic fibers) impregnated with binder is wound onto the surface of the liner.

The practical advantage of a high-pressure container with a housing of composite material lies in the fact that it is of sufficiently low weight, is easy to transport and can withstand considerable pressure (200 to 300 bar) over a large number of load cycles.

The effectiveness of composite pressure containers depends on the quality of reinforcement, i.e. on the type of continuous winding. The number and sequence of the layers, the angle of orientation of the fibers and the type of reinforcing materials, their proportion in the composite material and other parameters are determined for this purpose. "Layers" should be understood to mean layers with an appropriate arrangement of the reinforcing fibers (annular or spiral direction of arrangement) of the composite material in the winding. The linear density of the annular or spiral layers should be understood to means the total number of reinforcing fibers with appropriate arrangement, relative to a unit length of the cross section of the jacket. The sequence of the arrangement of layers with annular and spiral arrangement of the reinforcing fibers may vary over the thickness of the jacket wall.

The most significant requirements with regard to gas containers are reducing the specific material consumption of the container, which is determined by the ratio of the mass of the container to its volume, and ensuring an elevated service life measured in the number of load cycles allowing safe use.

The technology of container design as currently developed, which ensures not only the stability of the design under one-time static loading but also the future service life of the container, additionally specifies the restriction of possible destruction of the design under static limit load conditions with previously determined mode of destruction and the prevention of possible detachment of flying fragments (cf. for example Russian standard GOST NPB 190-2000, EN 12245, EN 14427, ISO 1119-3 etc.)

A high-pressure container is known from RU 2244868 C1 which comprises a thin-walled metallic cylindrical liner with a neck in the bottom and an outer reinforcing jacket of composite material, formed by a combination of groups of layers of high modulus fibers of a reinforcing material oriented spirally and circumferentially with previously specified linear densities.

A particular disadvantage of the known solution of container design with a jacket of composite material consists in the fact that it does not satisfy the requirements of the stated standardization documents with regard to type of destruction under limit loads. This disadvantage stands in the way of widespread use in the home and on means of transport.

SUMMARY OF THE INVENTION

The object of the present invention is to provide a high-pressure container which exhibits high stability and a long service life and which does not constitute a hazard in the event of destruction due to excessive pressure.

This object is achieved by a high-pressure container, which comprises a thin-walled, closed, leakproof metallic liner with a cylindrical portion and at least one neck and an outer reinforcement jacket of composite material surrounding the liner, which jacket is formed of at least one group of layers of high modulus fibers of a reinforcement material, these being oriented spirally and annularly relative to the liner with a previously determined linear density, a layer of spirally oriented fibers being arranged over a layer of annularly oriented fibers. On the cylindrical portion of the liner a local break belt is provided in the reinforcing jacket in the form of a portion of the reinforcing jacket, which break belt is defined on the inside by the cylindrical surface of the liner and on the outside by an altogether concave surface, which is formed of spirally oriented fibers of the reinforcing material, wherein the linear density of the fibers of a layer of the reinforcing material of annularly oriented fibers at the portion of the local break belt amounts to no more than 70% of the linear density of this layer over the remaining cylindrical portion.

The advantage of the invention lies in the simplicity of its industrial realization and the attractiveness for the user, is because the destruction of the high-pressure container on reaching a limit load is not dangerous, since no fragments escape in the event of such destruction. The high-pressure container is therefore especially suitable for use in the home and on means of transport in which pressurized gases are used, such as for example for gas tanks in motor vehicles.

The concave surface may be formed for example of the surface of a single-shell hyperboloid of revolution, which is directed with its tapering portion toward the axis of symmetry of the container, wherein the outer surface of the single-shell hyperboloid of revolution is formed of spirally oriented fibers of a reinforcing material.

In a preferred embodiment of the invention, in which the concave surface is formed of a hyperboloid of revolution, the width of the local break belt is selected on the basis of the condition that the equation $d_1 * \sin \phi_1 = d_2 * \sin \phi_2$ is met for the spirally oriented fibers of the reinforcing material, wherein $d_1$ is the diameter of the section through the cylindrical surface of the reinforcing jacket outside the local break belt;

$d_2$ is the diameter of the smallest cross-sectional area of the hyperboloid of revolution, which is formed over the width of the local break belt;

$\phi_1$, $\phi_2$ are the respective angles of orientation of the spiral fibers in the stated sections.

In preferred embodiments homogeneous layers of the reinforcing material, which are formed by spirally and annularly oriented fibers, are arranged at surfaces which, compared to their arrangement at the remaining cylindrical part of the liner, are equidistant from the surface of the liner, and/or in the local break belt the linear density of the fibers of the circumferential reinforcement gets gradually smaller toward the middle of the local break belt, i.e. in an individual case up to half the length of the generatrix of the hyperboloid on the side of its smallest cross section.

The width of the local break belt amounts to 15 to 30 times, preferably to 20 to 25 times the total thickness of the annular strips of reinforcing material outside the region of the local break belt.

EMBODIMENTS OF THE INVENTION

Figure 1:
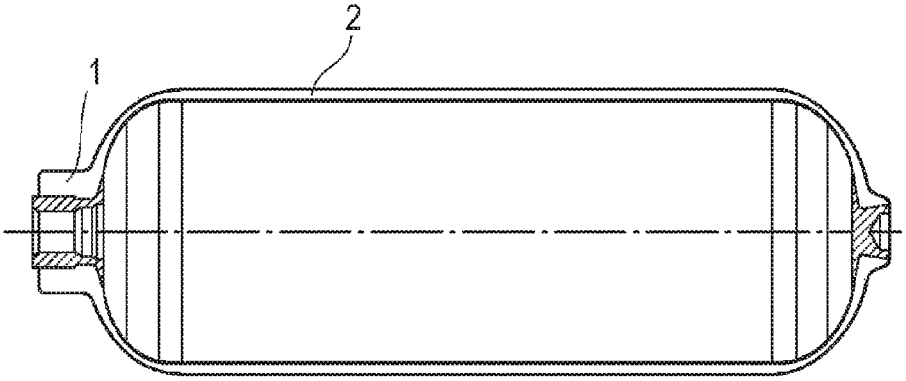
Fig. 1 PRIOR ART
FIG. 1 is a longitudinally sectional view of a high-pressure container known from the prior art.

As FIG. 1 shows, the high-pressure container known from the prior art for a fluid medium (liquid or gas) comprises a leakproof metallic liner 1 and a reinforcing jacket 2, which is made from a composite material, for which high strength fibers are used, for example carbon fibers or glass fibers. The jacket 2 shown is achieved in that identically oriented fibers are wound spirally and annularly onto a metallic liner 1, wherein each ply of the carcass is simultaneously impregnated with a polymer binder, for example with epoxy resin, and then thermally cured. The result is the construction of a container whose weight is sufficiently low and which can withstand multiple pressure load cycles.

The mode of operation of the container's composite material-reinforcing jacket constructed according to the invention consists in its being in a prestressed-deformed state under the action of an internal pressure, in which a concentration of the stresses in the annular reinforcing material is restricted to a local belt and no changes take place in the spiral reinforcing material. When a limit pressure is reached in the container, the annularly arranged reinforcing material is destroyed over the width of the local belt, the metallic liner also being destroyed, and the outer spiral reinforcing material is deformed, since its is present at the outer surface in the form of a single-shell hyperboloid, and assumes the shape, by widening only in the portion of the local break belt, of a "Chinese lantern" (FIG. 7), whereby metal fragments which arise on destruction of the liner may be stopped from escaping.

Figure 2:
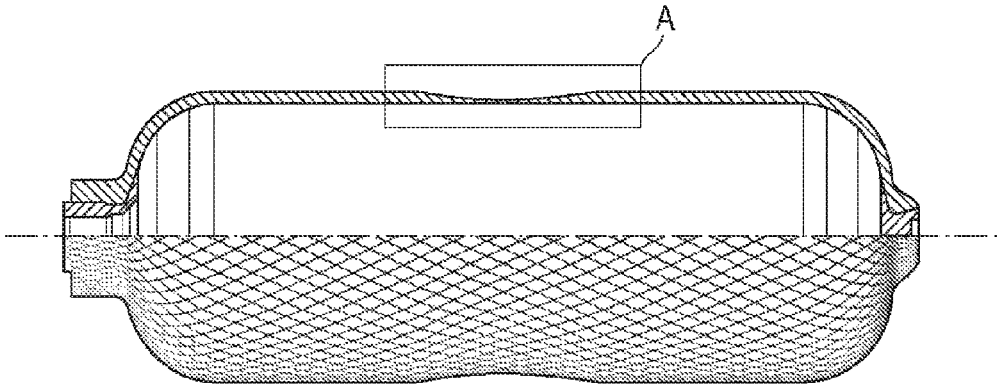
FIG. 2 is a partially longitudinally sectional view of a high-pressure container according to the invention.
Figure 3:
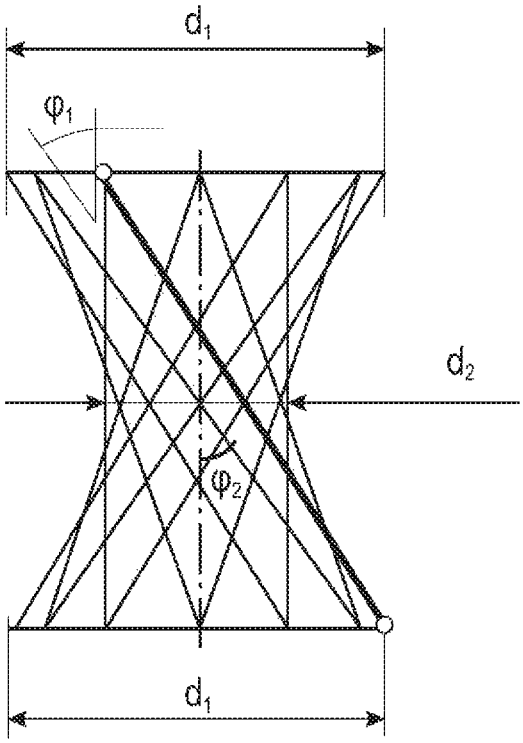
FIG. 3 is a schematic representation of the arrangement of fibers of a spiral reinforcement at a portion of a break belt.
Figure 4:
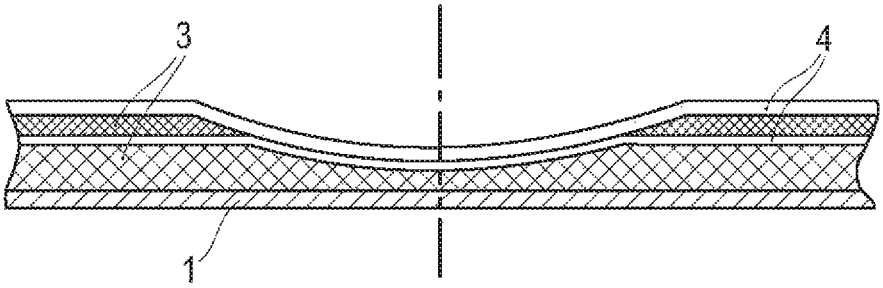
FIG. 4 shows detail A of the sectional profile of the local break belt shown in FIG. 2.

The high-pressure container according to the invention of FIGS. 2 to 4 is produced as follows. To produce the reinforcing jacket 2, the fibers of the annular reinforcing layer 3 are wound around the liner 1, wherein over a specific length of the cylindrical part of the liner 1, which corresponds to the width of the future local break belt, the linear density of the annular reinforcing layer 3 is less than the density of the annular reinforcing layer 3 over the remaining length of the cylindrical part of the liner 1. In this way, the thickness of the annular reinforcing layer 3, which is achieved in the region of the local break belt, is less than the total thickness of the annular reinforcing layer 3 in the remaining part of the liner 1. This reinforcing pattern results in a local concentration of the peripheral stresses which arise in the composite material of the reinforcing jacket 2 when the receptacle is exposed to internal pressure. Winding of the fibers of the spiral reinforcing layer 4 in the region under consideration is not performed until after winding of the fibers of the annular reinforcing layer 3. If the width of the region of the local break belt is selected appropriately, then as a result of the thickness of the material of the region under consideration being less than the total thickness of the material, when winding the spiral fibers a surface in the form of a single-shell hyperboloid of revolution is formed, which is oriented with its pole toward the axis of symmetry of the container. Overall, such a reinforcement allows the creation of a local break belt in the reinforcing jacket.

The width of the local break belt may be defined as the width of the area of disturbance of the edge effect on joining the jackets of different thicknesses. It is convenient, to achieve the necessary strength, to select this width such that it amounts to 15 to 30 times, or preferably 20 to 25 times the thickness of the reinforcing jacket of the container.

On the other hand, to satisfy the requirement for forming a one-piece structure of the composite material by closely-packed application of the fibers of the spiral and annular reinforcement in the process of the industrial realization of the method of winding the fibers of the spiral reinforcement over the length of the local break belt, the following condition must be fulfilled:

wherein $d_1$ is the diameter of a cross section in the region of the cylindrical surface of the reinforcing jacket, $d_2$ is the diameter of the smallest cross section in the region of the surface of the single-shell hyperboloid of revolution, $\phi_1$, $\phi_2$ are the respective angles of orientation of the spiral fibers in the stated sections.

The end result being selection of a width L for the local break belt which is defined by the ratio:

$$L=d_1 \arccos(d_2/d_1)\cos\phi/\sqrt{(1+\cos^2\phi_1)}$$

If the width of the local break belt is calculated according to this dependency, this must also be compared on calculation with the recommended width, which is equal to 20 to 25 times the thickness of the reinforcing jacket of the container. Ultimately, the larger of these widths may be selected.

Figure 5:
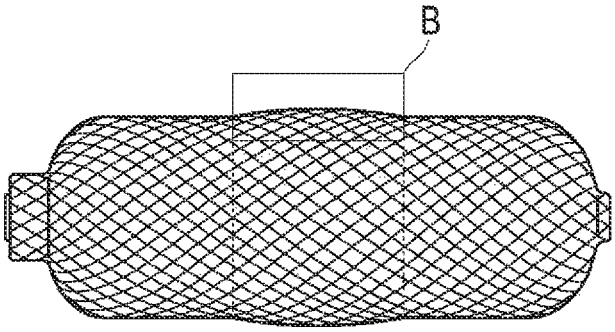
FIG. 5 shows the outer view of a destruction pattern of the local break belt.
Figure 7:
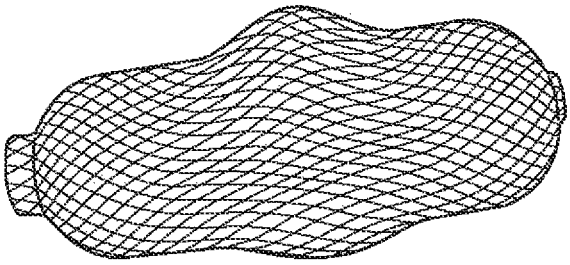
FIG. 7 is a view of the destruction in the local belt of an experimental container at a pressure of 930 bar.

When selecting these ratios it is advisable to reduce the amount of reinforcing material over the width of the local break belt compared with the quantity of reinforcing material at the remaining cylindrical part of the reinforcing jacket by at least 30%. The reduction in the quantity of reinforcing material by 30% to 40%, preferably by 30%, is most advantageous For fragment-free destruction of the container over the width of the local break belt, it is convenient to arrange similar layers of the reinforcing material, which are in each case formed of fibers oriented in the spiral and annular directions of the cylindrical portions, on surfaces which are arranged at different distances from the surface of the liner 1. That is to say, over the given length firstly only the fibers of the annular reinforcing layer 3 are placed onto the liner, while the fibers of the spiral reinforcing layer 4 are applied from the outside of the reinforcing jacket, as illustrated in FIG. 4. Over the entire remaining length of the cylindrical part of the container the layers 3, 4 of the reinforcing material, which are formed of fibers which are oriented in the spiral and annular directions of the cylindrical portion, are arranged on both sides of the break belt alternately in pairs on the surfaces which are arranged equidistant from the inner surface of the liner for the layers of similar type. That is to say, a layer 3 of the annular reinforcement and a layer 4 of the fibers of the spiral reinforcement follow one another in pairs in the direction of the enlargement of the thickness of the wall of the reinforcing jacket. FIG. 4 shows two such sequences. However, there may also be 1 or 3 or 4 or more such sequences. This arrangement and sequence of the layers of the reinforcing fibers makes it possible to limit destruction to the region of the break belt in the form of a "Chinese lantern" and to prevent any fragments from flying out on destruction of the liner, as illustrated in FIGS. 5 and 7.

Figure 6:
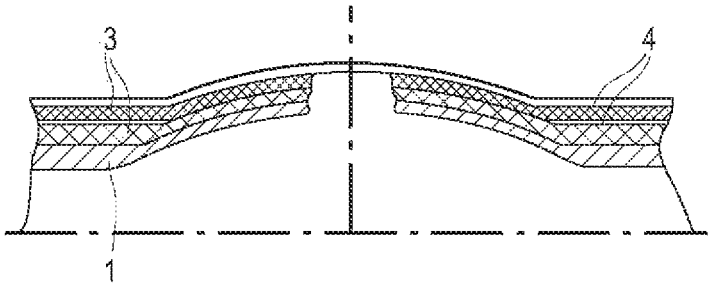
FIG. 6 shows detail B of the sectional profile of the local break belt shown in FIG. 5.

FIG. 6 shows a sectional profile of the local break belt in the destroyed state. On a critical pressure being exceeded in the container, all the layers of the reinforcing jacket were destroyed, with the exception of the top reinforcing layer 4 of spirally arranged fibers, which on exposure to pressure assumed a bulging shape, retaining the damaged reinforcing layers 3 located therebelow of annularly arranged fibers and the reinforcing layer 4 of spirally arranged fibers lying therebelow.

The proposed solution was embodied using the example of a pressure container with a volume of 7 liters, an operating pressure of 300 bar and a destruction pressure of at least 900 bar. The reinforcing jacket was made from carbon-reinforced plastics, and the top wound-on layer was made of glass fibre. FIG. 7 shows typical destruction of the container in the region of the local break belt at a pressure of 930 bar.

INDUSTRIAL APPLICABILITY

The invention may be applied to high-pressure containers which are used in particular in portable oxygen respirators for mountaineers and rescue workers, in mobile refrigeration and fire protection products, in gas supply systems and in automotive engineering.

The invention claimed is:

1. A high-pressure container comprising:

a thin-walled, closed, leakproof metallic liner with a cylindrical body portion and at least one neck;

an outer layer of spirally extending high modulus fibers surrounding the liner, a total number of the spirally extending fibers of the outer layer relative to a unit length of the outer layer being substantially uniform over the entire length of the cylindrical body portion; and an inner layer of annularly extending high modulus fibers surrounding the liner, forming with the outer layer a reinforcing jacket, and covered by the outer layer, a total number of the annularly extending fibers of the inner layer relative to a unit length of the jacket being in a local break belt extending around the cylindrical body portion of the liner equal to at most 70% of a total number of the fibers of the inner layer relative to a unit length of the jacket to both sides of the local break belt such that an outer surface of the outer layer has an outwardly concave shape at the local break belt.

2. The container according to claim 1, wherein the local break belt has an outwardly concave outer surface formed as a hyperboloid of revolution.

3. The container according to claim 1, wherein a width of the local break belt is such that the equation $d_1 \times \sin \phi_1 = d_2 \times \sin \phi_2$ is satisfied for the spirally oriented fibers of the fibers, when $d_1$ is the diameter of a cross section in the region of the cylindrical surface of the reinforcing jacket outside the local break belt, $d_2$ is the diameter of the smallest cross section in the region of the surface of the single-shell hyperboloid of revolution in the local break belt, $\phi_1$, $\phi_2$ are the angles of orientation of the spiral fibers in the regions of respective diameters $d_1$ and $d_2$.

4. The container according to claim 1, wherein the inner and outer layers of the fibers are arranged over the width of the local break belt on surfaces that, compared with the arrangement of the corresponding layers on the remaining cylindrical part of the liner, are at different distances from the outer surface of the liner.

5. The container according to claim 4, wherein the inner and outer layers are arranged on the cylindrical portion of the reinforcing jacket on both sides of the local break belt, in pairs on surfaces equidistant from the inner surface of the liner.

6. The container according to claim 1, wherein the total number of the fibers of the jacket reduces gradually toward the middle of the local break belt.

7. The container according to claim 1, wherein a width of the local break belt exceeds the total thickness of the outer reinforcing jacket outside the region of the local break belt by 20 to 25 times.

* * * * *